US006575174B2

(12) United States Patent
Lee

(10) Patent No.: US 6,575,174 B2
(45) Date of Patent: Jun. 10, 2003

(54) HAIR GROOMING BRUSH

(76) Inventor: Young S. Lee, 500 S. Catalina #310, Los Angeles, CA (US) 90020

( * ) Notice: Subject to any disclaimer, the term of this patent is extended or adjusted under 35 U.S.C. 154(b) by 64 days.

(21) Appl. No.: 09/823,348

(22) Filed: Apr. 2, 2001

(65) Prior Publication Data

US 2001/0035191 A1 Nov. 1, 2001

Related U.S. Application Data

(63) Continuation-in-part of application No. 09/560,809, filed on Apr. 28, 2000.

(51) Int. Cl.[7] ..... A45D 24/00
(52) U.S. Cl. ..... 132/160; 132/148; 132/219
(58) Field of Search ..... 132/160, 219, 132/159, 161, 148, 142, 141, 139, 138, 126, 120, 107

(56) References Cited

U.S. PATENT DOCUMENTS

| | | | | |
|---|---|---|---|---|
| 750,238 A | | 1/1904 | Bechtold | |
| 1,074,893 A | | 10/1913 | Pearce | |
| 2,348,339 A | | 5/1944 | Golden | 132/18 |
| 2,372,080 A | | 3/1945 | Hahn et al. | 132/26 |
| 2,479,631 A | | 8/1949 | Liebert | 132/23 |
| 2,815,032 A | * | 12/1957 | Rosenfeld | 132/121 |
| 2,984,248 A | | 5/1961 | Sidelman | 132/158 |
| D244,568 S | | 6/1977 | Lepisto et al. | D4/35 |
| 4,612,944 A | * | 9/1986 | Bachrach et al. | 132/148 |
| D290,910 S | | 7/1987 | Steadman et al. | D4/136 |
| D366,567 S | | 1/1996 | Gertsma et al. | D4/136 |
| 5,819,758 A | * | 10/1998 | Sohler | 132/121 |
| 5,884,633 A | * | 3/1999 | Ford | 132/137 |
| 5,975,089 A | * | 11/1999 | Simon | 132/113 |

* cited by examiner

*Primary Examiner*—John J. Wilson
*Assistant Examiner*—Robyn Kieu Doan
(74) *Attorney, Agent, or Firm*—Park & Sutton LLP; John K. Park

(57) ABSTRACT

A hair grooming brush with a plurality or rows of curved wavy bristles, rather than traditional straight bristles found on brushes and combs. The curvature of the bristles produces a springiness to the bristles when pressure is applied during the combing action. The springiness of the numerous rows of bristles, translates into a massaging effect upon the hair and scalp. Rows of curved bristles are more effective at untangling the hair. The three different sections of the bristle, the lower, middle and tip sections, can be either straight or curved. Additionally the rows can alternate between various formations of bristles.

19 Claims, 6 Drawing Sheets

26
24
14
12

HAIR GROOMING BRUSH

RELATED APPLICATION

This application is a continuation-in-part of U.S. patent application Ser. No. 09/560,809 filed Apr. 28, 2000.

BACKGROUND OF THE INVENTION

The invention relates to a hair grooming brush having a handle and bristles, most commonly a brush. Prior art brushes come in a variety of designs. The prior art brushes having straight bristles or combs with straight or curved bristles.

Most of the present conventional hair grooming brushes with straight shaped bristles, are either sparsely populated with such bristles or too densely populated. Hair grooming brushes with sparsely populated bristles just pass through the hair, providing minimal massaging or combing effect to the hair. Those hair grooming brushes with densely populated bristles tend to become entangled in the hair. Prior art brushes only have straight bristles and are not found with curved bristles. Combs with curved bristles only have one row of bristles, so combs do not steadily massage the scalp and provide waviness to the hair strands. A comb with wavy bristles would have to be pulled through the hair at a very rapid and uncomfortable speed, in order to emulate the benefits of a brush with numerous rows of curved bristles.

The straight bristles can be only forcibly pulled through the tangled hair and cause breaking of the hair strands. Straight bristles provide minimal lateral action that would serve to separate the tangled hair strands. The lateral action being the force that would tend to create a greater distance between the outer edge of the circumference of each bristle. The hair strands would be resting on the edge of the bristle, so as the distance between the bristle circumference edge increases, this lateral force would then tend to separate the hair strands as the distance between the hair strands also increases.

Hair grooming brushes with straight bristles create a massaging effect by the person placing force upon the brush in the direction of the scalp. This force can be inconsistent and erratic as the combing action occurs. Combs have only one row of bristles that provide minimal massaging effect, when compared to a brush with many rows of bristles. Combs with their one row of bristles, would need to be passed rapidly through the hair strands to simulate the effects of a multiple rowed brush. The rapid movement of a comb would tend to snag the hair strands and cause discomfort.

Hair grooming brushes with straight bristles do not provide any waving or curling effect to the hair. The straight bristles simply pass through the hair without applying any lateral force that would bend and shape the hair. Brushes with straight bristles require the user to twist the hair grooming brush to create any curling or waving effect to the bristles. Combs with one row apply pressure to the hair strands for only a short period of time. There is simply not enough continuous contact between the comb and the hair strands to provide proper waving and curling of the hair.

The shortcomings of the prior art hair grooming brushes show the need for a brush that will massage the hair and scalp, while still moving easily through the hair and providing the proper combing effect. The desire of so many individuals to add a natural waving effect to their hairstyle and the failure of prior art brushes to provide that result emphasizes the need for such a hair grooming brushes.

SUMMARY

It is an object of the present invention, with its curved bristles, to overcome the deficiencies of the prior art hair grooming brushes that have only straight bristles or provide only one row of curved bristles. Multiple rows of curved bristles provide a continuous untangling action as the brush passes through the hair strands. Another advantage of multiple rows of curved bristles is the firm and continuous massaging effect upon the scalp as the brush interacts with the scalp and hair strands.

Prior art brushes only have straight bristles and are not found with curved bristles. Combs with curved bristles only have one row of bristles, so combs do not steadily massage the scalp and provide waviness to the hair strands. A comb with wavy bristles would have to be pulled through the hair at a very rapid and uncomfortable speed, in order to emulate the benefits of a brush with numerous rows of curved bristles.

The hair grooming brush includes a platform and a plurality of rows with numerous bristles in each row attached to the platform. The platform includes a first section, a second section and a third section. Each bristle has a bristle tip and a bristle base. Each bristle is divided into a lower section, a middle section, and a tip section.

The bristles also have a plurality of bristle centers that are the center of the area of any given cross-section of the bristle. A bristle centerline follows about the continuous line formed by the bristle centers from the bristle tip to the bristle base. There is a bristle perpendicular axis that is a straight line perpendicular to the platform at the bristle base.

The curvature of the bristles is created by the distance between a point on the bristle perpendicular axis and the equivalent point on the bristle center line varying from about 0 to about 0.3 inches. The three different sections of the bristle, the lower, middle and tip sections, can be either straight or curved. Also, from about 10% to 90% of the bristles can be straight with the remainder being curved bristles.

It is an objective of the new hair grooming brush to provide a massage to the hair and scalp. A hair grooming brush with many rows of curved bristles can create a massaging effect by the person placing force upon the brush in the direction of the scalp, just as the brushes with straight bristles do. Additionally, curved bristles tend to bend and retain some of the force, rather than transferring all of the force directly to the scalp, with the force gradually releasing to provide even massaging pressure. Numerous rows on the brush provide a steady and continuous contact upon the hair strands. The steady contact produces a pleasing massaging effect and promotes wavy hair.

The curvature of the bristles produces a springiness and a bending to the bristles when pressure is applied during the brushing action. The springiness of the bristle then translates into a massaging effect upon the hair and scalp. Also, the curvature of the bristles provides a healthy shaking effect to the root of the hair. The temporary retention and gradual release of the force create a consistent massaging force upon the scalp. Each individual curved bristle produces a greater massage effect than is accomplished by a single straight bristle, this allows the bristles to be spaced farther apart and minimizes the tangling of the hair within the bristles. The bristles can be randomly placed on the platform of the brush, which provides random yet frequent massaging of the scalp. The rows of bristles can be varied between a row of straight bristles and an alternate row of curved bristles.

The curved bristles are also more effective in untangling the hair. Curved bristles provide lateral action that serves to separate the tangled hair strands. As the brush is pulled through the hair the distance between the outer circumference edge of the bristles can increase and decrease significantly, because the distance from the perpendicular axis to the outer edge of the bristle varies over the height of the curved bristle. Since the hair strands are lying on the bristles, this increasing and decreasing of distance between the perpendicular axis and outer edge tends to pull the hair strands apart, creating an effect that serves to untangle the hair strands.

Another advantage is the natural waving effect given to the hairstyle by the waved bristles. The curvature of the bristles gently bends and shapes the strands of hair to provide a waving effect and the appearance of thicker hair.

The bristles may be of varying materials that provide the proper stiffness and resiliency to render the desired massaging to the scalp and natural waviness to the hair. The tip may be a plastic or metal ball, which provides a gentle massage effect to the scalp in contrast to the sharper pointed bristle tips that dig deeper into the scalp and create a more vigorous and stimulating massage. The mixture of bristles may be from 10% to 90% straight, with the remainder being curved bristles. There are many combinations of bristle formations available including varying the mixture of straight and curved bristles; alternating the bristle style between adjacent rows; and varying the bristle style between the first, second and third section of the platform.

The invention is in the form of a brush. Commonly the brush would have a handle, although a strap may also be used for holding the brush. The strapped brush is more commonly used for the grooming of animals.

The invention is further described in the appended drawings, description and claims.

DETAILED DESCRIPTION

Figure 1:
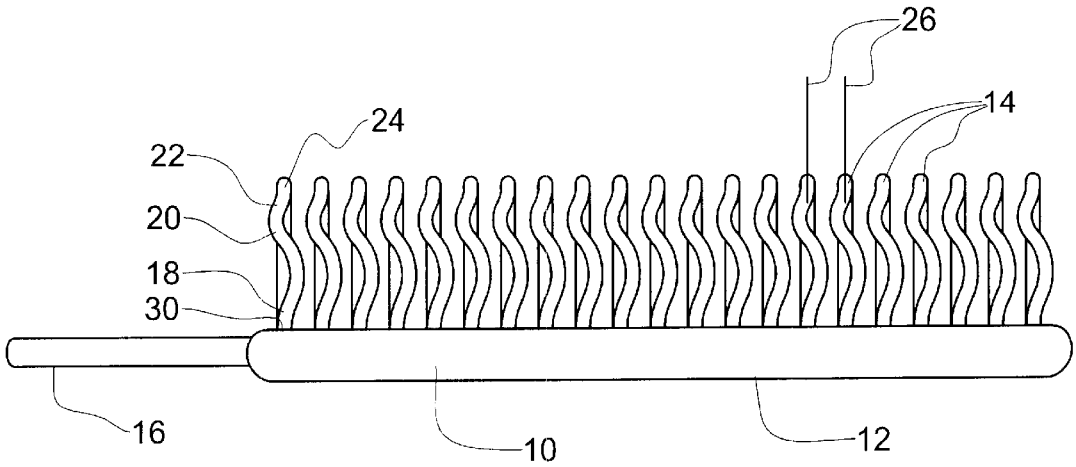
FIG. 1 is a side perspective view of a present embodiment of the hair grooming brush as a brush.
Figure 2:
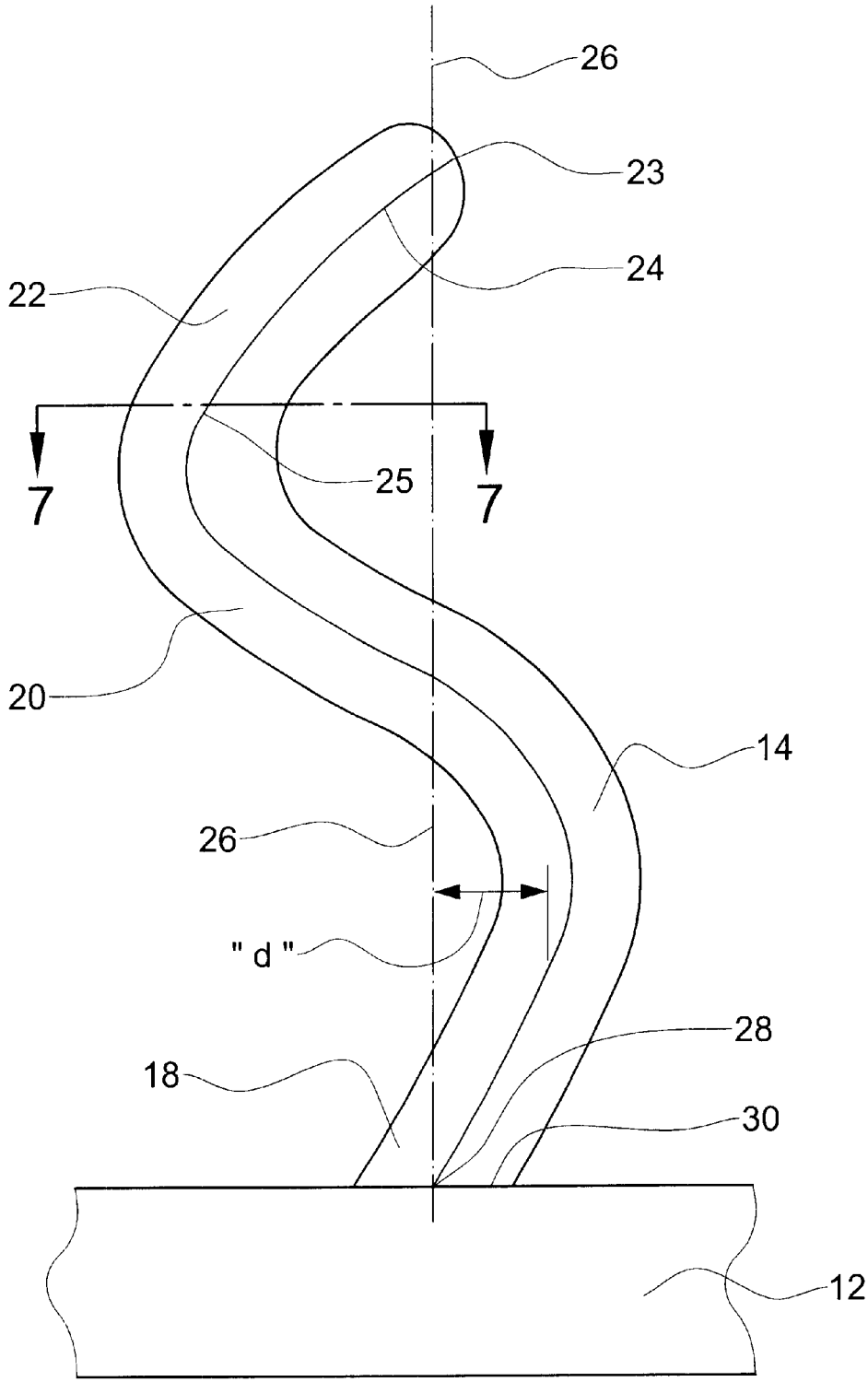
FIG. 2 is an enlarged side perspective view of a bristle.

Referring to FIG. 1, FIG. 2, FIG. 7 and FIGS. 8*a*–8*c*, a hair grooming brush 10 is made of a platform 12, a plurality of rows 13 having a plurality of bristles 14 in each row, and a handle 16. The bristles have a bristle tip 23, bristle base 30, lower section 18, a middle section 20 and a tip section 22. Each bristle has a plurality of bristle centers 25, which is the center of the area of any given cross-section of the bristle 14. The bristle centerline 24 follows about the continuous line formed by the bristle centers 25 from the bristle tip 23 to the bristle base 30.

A perpendicular axis 26 runs in a straight line perpendicular from the platform 12. The perpendicular axis 26 intersects the platform 12 at the same point 28 where the bristle centerline 24 intersects the platform 12. This point 28 is also the centerline of the bristle base 30. The bristle base 30 is defined as the cross section of the bristle that intersects the upper surface of the platform 12. The bristle 14 height is about 0.7 inches in the preferred embodiment, but may be of other lengths.

"d" is the distance between the bristle center line 24 and the perpendicular axis 26. In the embodiment depicted "d" begins at 0 inches at the bristle base 30, increases to about 0.3 inches, then decreases to 0 inches at the perpendicular axis 26, then increases to about 0.3 inches, then decreases to about 0 inches at the bristle tip 23.

Although not shown, combs with curved bristles 14 only have one row 13 of bristles 14, so combs do not steadily massage the scalp and provide waviness to the hair strands 34. A comb with curved wavy bristles 14 would have to be pulled through the hair at a very rapid and uncomfortable speed, in order to emulate the benefits of a brush with numerous rows 13 of curved bristles 14. The comb would snag in the hair strands 34 and cause discomfort.

In the preferred embodiment the handle 16 is a continuous part of the platform 12. In alternate embodiments the handle 16 may be manufactured as a separate piece and attached to the platform 12. The handle 16 and platform 12 may be of varying materials including wood, metal or plastic. Although not explained or shown on the drawing, the tip 23 may be a plastic or metal ball.

Figure 3:
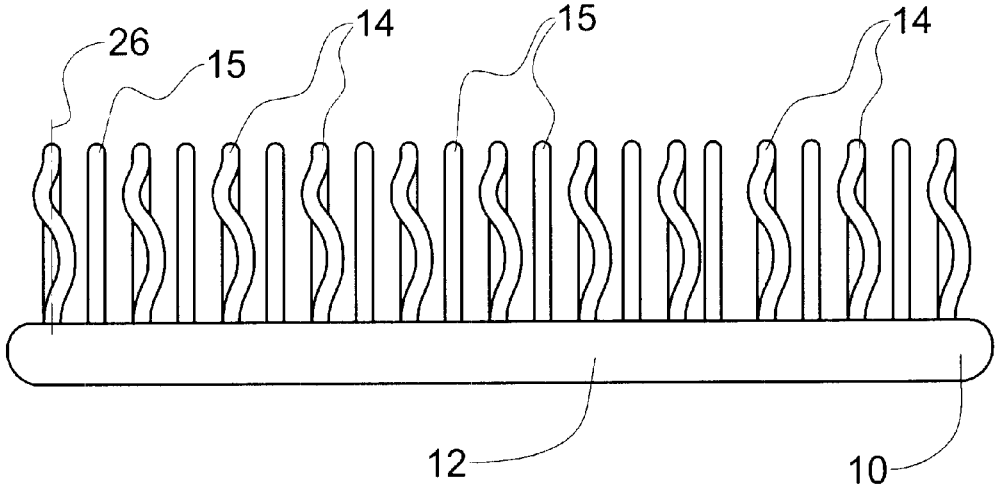
FIG. 3 is a side perspective view of the hair grooming brush without a handle, having a mixture of straight and curved bristles.

Referring to FIG. 3, the hair grooming brush 10 is shown without a handle. The bristles 14 have the same characteristics as the embodiment with a handle. Straight bristles 15 are shown, where "d" would be about 0 inches. The preferred embodiment has 50% straight bristles 15, although the mixture may be from about 10% to 90% straight bristles 15. The perpendicular axis 26 is shown.

Figure 4:
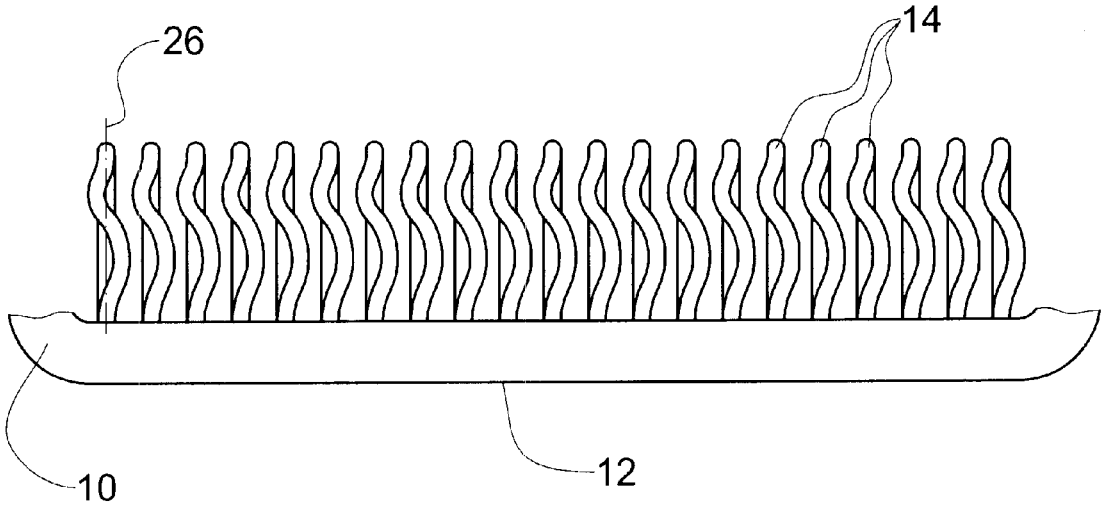
FIG. 4 is a side perspective view of the hair grooming brush without a handle, having all curved bristles.

FIG. 4 illustrates the embodiment of the hair grooming brush 10 with all curved bristles 14. The bristles 14 are commonly made of plastic, but may be of wood, metal or other materials. The perpendicular axis 26 is shown.

Figures 5A, 5B, 5C, 5D, 5E, 5F, 5G, 5H, 5I, 5J:
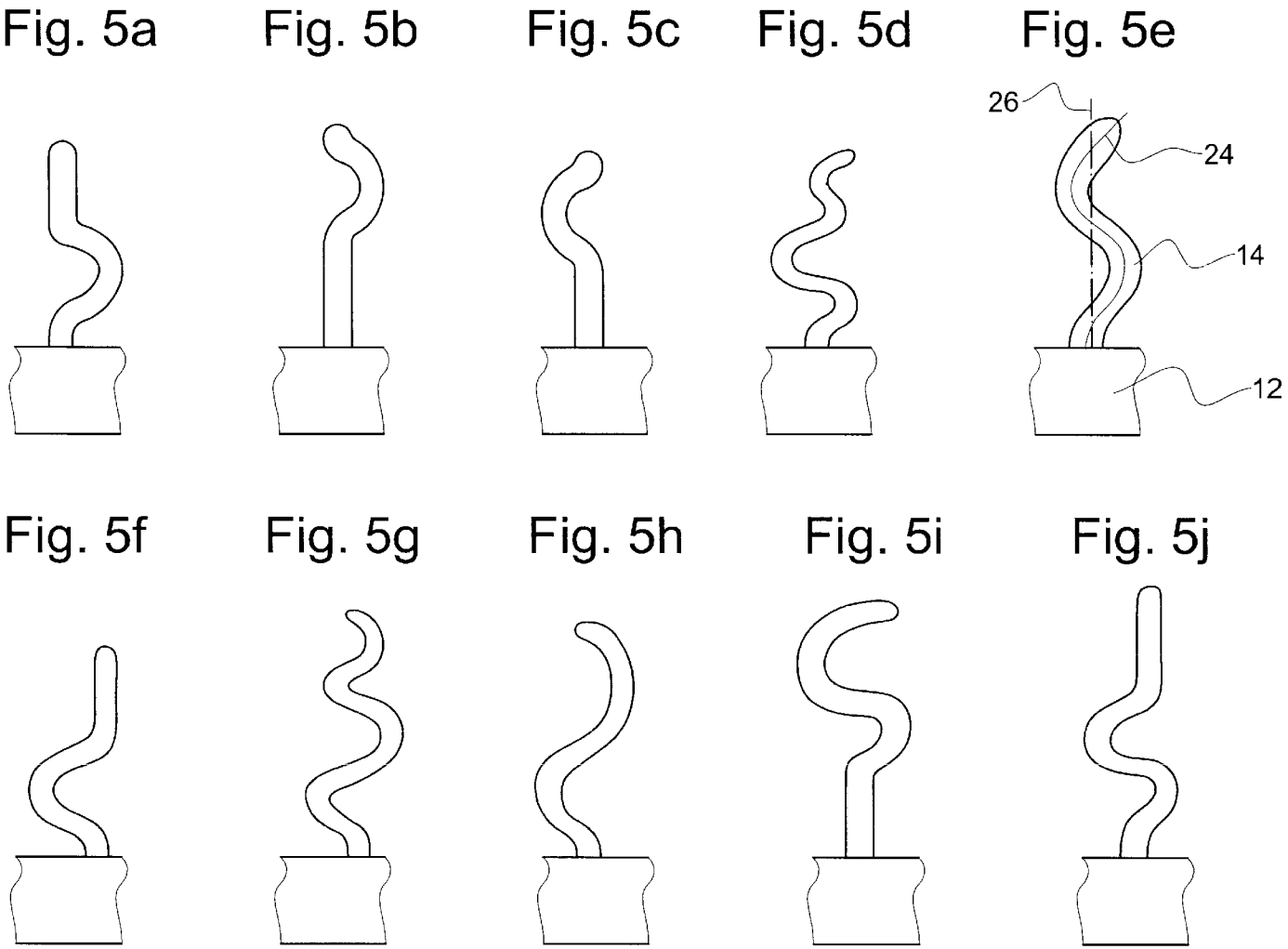
FIGS. 5*a*–5*j* show examples of various bristle configurations.

Referring to FIGS. 5*a*–5*j*, are shown examples of various bristle 14 configurations. FIG. 5*a* shows a single right curvature on the lower section 18. FIG. 5*b* shows a single right wave on the top section. FIG. 5*c* shows a single left wave on the tip section. FIG. 5*d* shows four waves with a right wave beginning from the platform. FIG. 5*e* shows a double wave with a right wave beginning at the platform 12. FIG. 5*f* illustrates a single left wave beginning at the platform. FIG. 5*g* illustrates four waves with a left wave beginning from the platform. FIG. 5*h* illustrates a double wave with a left wave beginning at the platform. FIG. 5*i* illustrates a double wave at the top and a straight section at the bottom. FIG. 5*j* illustrates a double wave at the bottom and a straight section at the top.

Figure 6:
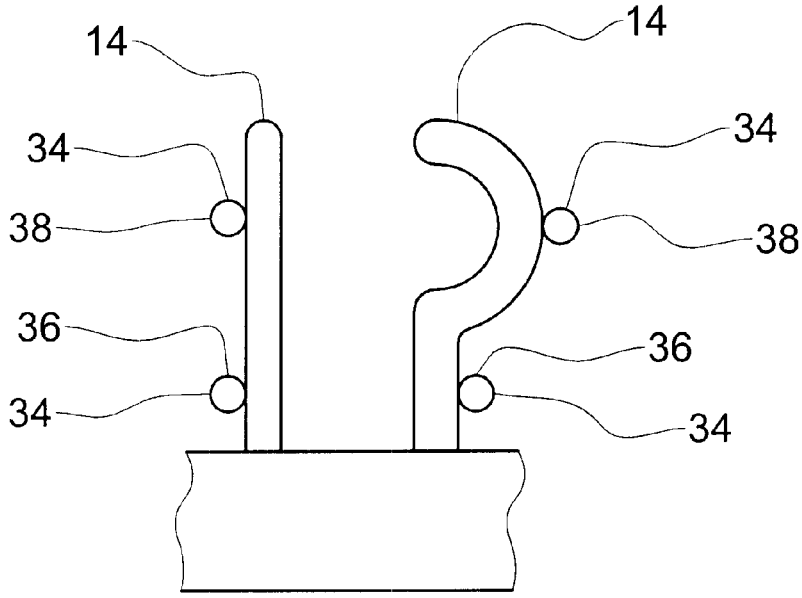
FIG. 6 shows an example of the lateral force created by the curved bristles.
Figure 7:
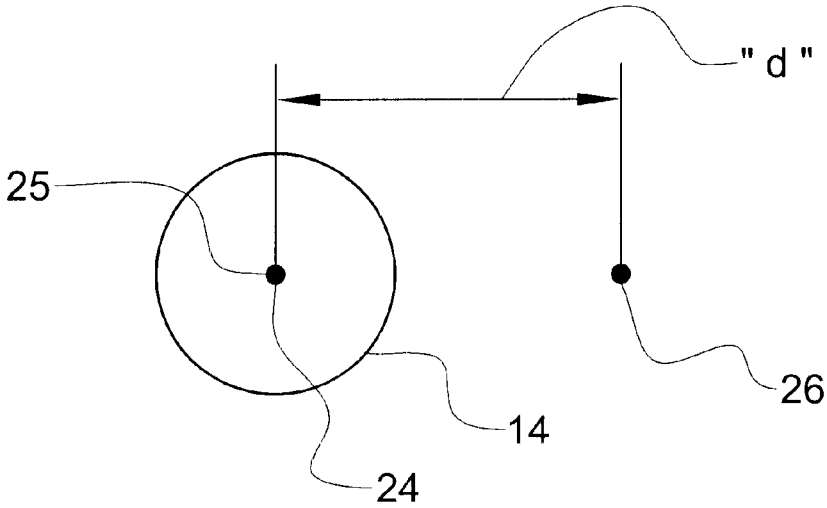
FIG. 7 shows a top view of a cut portion from the bristle displaying "d", the distance, between the bristle centerline and the perpendicular axis.

Referring to FIG. 6, there is shown an example of the lateral force action that separates the tangled hair strands. FIG. 6 shows an example with bristles 14 being straight and curved. The hair strands 34 are shown at the bottom of the bristle 14 in position 36, as the bristles 14 are pulled through the hair some of the hair strands 34 will glide towards the top of the bristles 14 into a new position 38. The distance between the hair strands 34 in this new position 38 is greater than at position 36, creating a lateral force upon the hair strands 34 that separates the tangled hair strands 34. Multiple rows 13 of bristles provide continuous action upon the hair strands 34, which steadily and gently separates the tangled hair and massages the scalp.

Figure 8A:
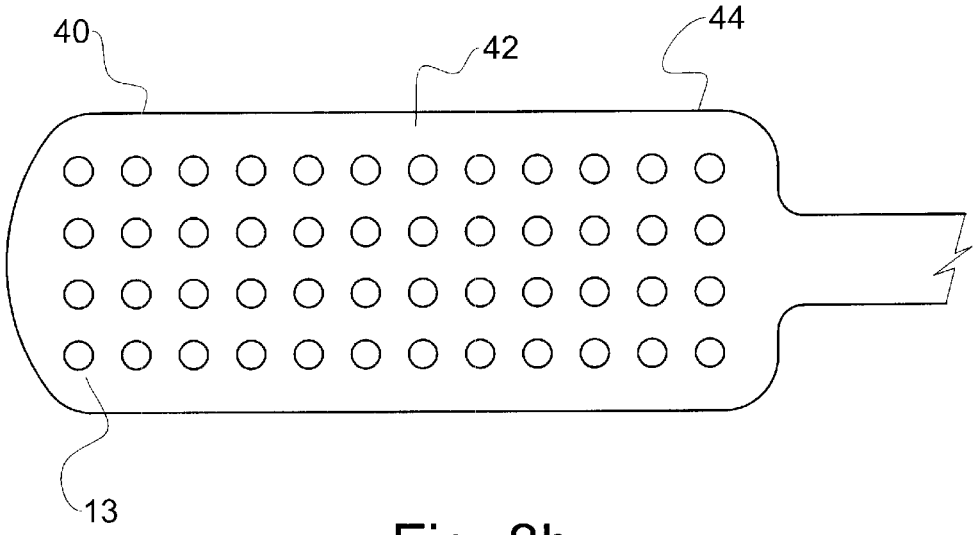
FIG. 8*a* shows a top view of the brush with a handle having numerous row of bristles.
Figure 8B:
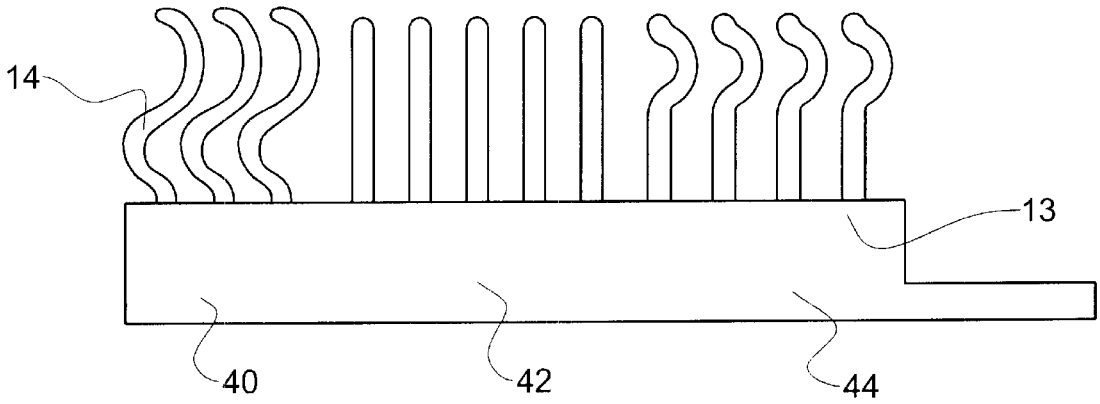
FIG. 8*b* shows a side view of FIG. 8*a*, illustrating the different bristle styles in the first area, second area and third area of the brush.

Referring to FIG. 8*a*, a top view of the brush 10 with a handle having numerous rows 13 of bristles 14 is shown. The multiple rows 13 of bristles 14 provide a steady massaging action to the scalp. The hair grooming brush 10 has a first area 40, a second area 42 and a third area 44. FIG. 8*b* shows a side view of FIG. 8*a*. Each of the three areas 40, 42, 44 has a different shaped bristle 14. For the bristles 14 in the first area 40, the distance between a point on the bristle perpendicular axis 26 and the equivalent point on the bristle center line 24 varies from about 0 and about 0.3 inches. The bristles 14 in the second area 42 are straight. Each bristle 14 in the third area 44 has lower section 18, a middle section 20, and a tip section 22. The distance between a point on the bristle perpendicular axis 26 and the equivalent point on the bristle centerline 24 is about 0 throughout the lower section 18. The distance between a point on the bristle perpendicular axis 26 and the equivalent point on the bristle center line 24 gradually varies from between about 0 and about 0.3 inches throughout the middle section 20 and the tip section 22.

Figure 8C:
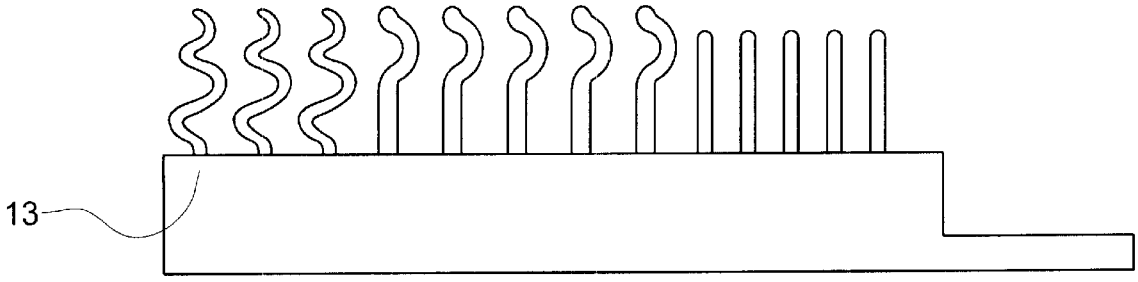
FIG. 8*c* shows a variation in the bristle arrangement compared to FIG. 8*b*.

FIG. 8*c* shows an alternate embodiment of the variation in bristle arrangement, from that shown in FIG. 8*b*. For the bristles 14 in the first area 40, the distance between a point on the bristle perpendicular axis 26 and the equivalent point on the bristle center line 24 varies from about 0 and about 0.3 inches. The bristles 14 in the third area 44 are straight. Each bristle 14 in the second area 44 has a lower section 18, a middle section 20, and a tip section 22. The distance between a point on the bristle perpendicular axis 26 and the equivalent point on the bristle center line 24 is about 0 throughout the lower section 18 and the middle section 20. The distance between a point on the bristle perpendicular axis 26 and the equivalent point op the bristle center line 24 gradually varies from between about 0 and about 0.3 inches throughout the tip section 22.

Although not shown specifically in the figures, the rows 13 of bristles 14 can also be alternated, where an initial row 13 has curved bristles 14 and an adjacent row 13 has straight bristles. Other combinations of alternating rows 13 can also be achieved by using two or more of the many variations of bristles 14 that have been described above and are illustrated in the FIGS. 5*a*–5*j*.

Although the present invention has been described in considerable detail with regard to the preferred embodiments thereof, it is not intended to be a limiting factor and other versions are possible. Therefore, the appended claims should not be limited to the descriptions of the preferred versions contained herein.

What is claimed is:

1. A hair grooming brush comprising:

a) a platform; and b) a plurality of rows of bristles, wherein each row has a plurality of bristles attached to the platform, wherein each bristle has a bristle tip, a bristle base, a plurality of bristle centers wherein a bristle center is the center of the area of any given cross-section of the bristle, a bristle center line wherein the bristle center line follows about the continuous line formed by the bristle centers from the bristle tip to the bristle base, and a bristle perpendicular axis wherein the bristle perpendicular axis is a straight line perpendicular to the platform at the bristle base, and wherein the distance between a point on the bristle perpendicular axis and the equivalent point on the bristle center line varies increasingly from about 0 inch to about 0.3 inches and then decreasingly from about 0.3 inches to about 0 inch.

2. The hair grooming brush of claim 1 further comprising a first area, second area and a third area; wherein for the bristles in the first area, the distance between a point on the bristle perpendicular axis and the equivalent point on the bristle center line varies from about 0 and about 0.3 inches, wherein the bristles in the second area are straight, wherein for the bristles in the third area each bristle further comprises of a lower section, a middle section, and a tip section, wherein the distance between a point on the bristle perpendicular axis and the equivalent point on the bristle center line is about 0 throughout the lower section, and the distance between a point on the bristle perpendicular axis and the equivalent point on the bristle center line gradually varies from between about 0 and about 0.3 inches throughout the middle section and the tip section.

3. The hair grooming brush of claim 1 further comprising a first area, second area and a third area; wherein in the first area the plurality of rows alternate between a row of bristles wherein the distance between a point on the bristle perpendicular axis and the equivalent point on the bristle center line varies from about 0 and about 0.3 inches for about 10% to 90% of the bristles, and wherein the remainder of the bristles are straight; and an alternate adjacent row wherein each bristle further comprises of a lower section, a middle section, and a tip section, wherein the distance between a point on the bristle perpendicular axis and the equivalent point on the bristle center line is about 0 throughout the tip section and middle section, and the distance between a point on the bristle perpendicular axis and the equivalent point on the bristle center line gradually varies from between about 0 and about 0.3 inches throughout the lower section; wherein the bristles in the second area are straight, and wherein for the bristles in the third area each bristle further comprises of a lower section, a middle section, and a tip section, wherein the distance between a point on the bristle perpendicular axis and the equivalent point on the bristle center line is about 0 throughout the lower section, and the distance between a point on the bristle perpendicular axis and the equivalent point on the bristle center line gradually varies from between about 0 and about 0.3 inches throughout the middle section and the tip section.

4. The hair grooming brush of claim 1 further comprising a first area, second area and a third area; wherein for the bristles in the third area, the distance between a point on the bristle perpendicular axis and the equivalent point on the bristle center line varies from about 0 and about 0.3 inches, wherein the bristles in the first area are straight, wherein for the bristles in the second area each bristle further comprises of a lower section, a middle section, and a tip section, wherein the distance between a point on the bristle perpendicular axis and the equivalent point on the bristle center line is about 0 throughout the tip section and middle section, and the distance between a point on the bristle perpendicular axis and the equivalent point on the bristle center line gradually varies from between about 0 and about 0.3 inches throughout the lower section.

5. The hair grooming brush of claim 1 further comprising a first area, second area and a third area; wherein for the bristles in the first area, the distance between a point on the bristle perpendicular axis and the equivalent point on the bristle center line varies from about 0 and about 0.3 inches, wherein the bristles in the third area are straight, wherein for the bristles in the second area each bristle further comprises of a lower section, a middle section, and a tip section, wherein the distance between a point on the bristle perpendicular axis and the equivalent point on the bristle center line gradually varies from between about 0 and about 0.3 inches throughout the lower section and the tip section, and the distance between a point on the bristle perpendicular axis and the equivalent point on the bristle center line is about 0 throughout the middle section.

6. The hair grooming brush of claim 1 further comprising a first area, second area and a third area; wherein for the bristles in the first area, the distance between a point on the bristle perpendicular axis and the equivalent point on the bristle center line varies from about 0 and about 0.3 inches, wherein the bristles in the second area are straight, wherein for the bristles in the third area each bristle further comprises of a lower section, a middle section, and a tip section, wherein the distance between a point on the bristle perpendicular axis and the equivalent point on the bristle center line is about 0 throughout the tip section, and the distance between a point on the bristle perpendicular axis and the equivalent point on the bristle center line gradually varies from between about 0 and about 0.3 inches throughout the lower section and the middle section.

7. The hair grooming brush of claim 1 further comprising a first area, second area and a third area; wherein for the bristles in the first area, the distance between a point on the bristle perpendicular axis and the equivalent point on the bristle center line varies from about 0 and about 0.3 inches, wherein the bristles in the second area are straight, wherein for the bristles in the third area each bristle further comprises of a lower section, a middle section, and a tip section, wherein the distance between a point on the bristle perpendicular axis and the equivalent point on the bristle center line varies from between about 0 to about 0.3 inches throughout the middle section, and the distance between a point on the bristle perpendicular axis and the equivalent point on the bristle center line is about 0 throughout the bottom section and the tip section.

8. The hair grooming brush of claim 1 further comprising a first area, second area and a third area; wherein for the bristles in the first area, the distance between a point on the bristle perpendicular axis and the equivalent point on the bristle center line varies from about 0 and about 0.3 inches, wherein the bristles in the third area are straight, wherein for the bristles in the second area each bristle further comprises of a lower section, a middle section, and a tip section, wherein the distance between a point on the bristle perpendicular axis and the equivalent point on the bristle center line is about 0 throughout the lower section and middle section, and the distance between a point on the bristle perpendicular axis and the equivalent point on the bristle center line gradually varies from between about 0 and about 0.3 inches throughout the tip section.

9. The hair grooming brush of claim 1 wherein the platform includes a handle.

10. A hair grooming brush comprising:

a) a platform having a first area, a second area and a third area; and b) a plurality of rows of bristles, wherein each row has a plurality of bristles attached to the platform, wherein each bristle has a bristle tip, a bristle base, a plurality of bristle centers wherein a bristle center is the center of the area of any given cross-section of the bristle, a bristle center line wherein the bristle center line follows about the continuous line formed by the bristle centers from the bristle tip to the bristle base, and a bristle perpendicular axis wherein the bristle perpendicular axis is a straight line perpendicular to the platform at the bristle base, and wherein the distance between a point on the bristle perpendicular axis and the equivalent point on the bristle center line varies increasingly from about 0 inch to about 0.3 inches and then decreasingly from about 0.3 inches to about 0 inch.

11. The hair grooming brush of claim 10 wherein for the bristles in the third area, the distance between a point on the bristle perpendicular axis and the equivalent point on the bristle center line varies from about 0 and about 0.3 inches, wherein the bristles in the first area are straight, wherein for the bristles in the second area each bristle further comprises of a lower section, a middle section, and a tip section, wherein the distance between a point on the bristle perpendicular axis and the equivalent point on the bristle center line is about 0 throughout the lower section, and the distance between a point on the bristle perpendicular axis and the equivalent point on the bristle center line gradually varies from between about 0 and about 0.3 inches for about 10% to 90% of the bristles throughout the middle section and the tip section.

12. The hair grooming brush of claim 10 wherein for the bristles in the first area, the distance between a point on the bristle perpendicular axis and the equivalent point on the bristle center line varies from about 0 and about 0.3 inches, wherein the bristles in the second area are straight, wherein for the bristles in the third area each bristle further comprises of a lower section, a middle section, and a tip section, wherein the distance between a point on the bristle perpendicular axis and the equivalent point on the bristle center line is about 0 throughout the lower section and middle section, and the distance between a point on the bristle perpendicular axis and the equivalent point on the bristle center line gradually varies from between about 0 and about 0.3 inches for about 10% to 90% of the bristles throughout the tip section.

13. The hair grooming brush of claim 10 wherein for the bristles in the first area, the distance between a point on the bristle perpendicular axis and the equivalent point on the bristle center line varies from about 0 and about 0.3 inches, wherein the bristles in the second area are straight, wherein for the bristles in the third area each bristle further comprises of a lower section, a middle section, and a tip section, wherein the distance between a point on the bristle perpendicular axis and the equivalent point on the bristle center line is about 0 throughout the tip section and middle section, and the distance between a point on the bristle perpendicular axis and the equivalent point on the bristle center line gradually varies from between about 0 and about 0.3 inches for about 10% to 90% of the bristles throughout the lower section.

14. The hair grooming brush of claim 10 wherein for the bristles in the first area, the distance between a point on the bristle perpendicular axis and the equivalent point on the bristle center line varies from about 0 and about 0.3 inches, wherein the bristles in the second area are straight, wherein for the bristles in the third area each bristle further comprises of a lower section, a middle section, and a tip section, wherein the distance between a point on the bristle perpendicular axis and the equivalent point on the bristle center line gradually varies from between about 0 and about 0.3 inches for about 10% to 90% of the bristles throughout the lower section and the tip section, and the distance between a point on the bristle perpendicular axis and the equivalent point on the bristle center line is about 0 throughout the middle section.

15. The hair grooming brush of claim 10 wherein for the bristles in the first area, the distance between a point on the bristle perpendicular axis and the equivalent point on the bristle center line varies from about 0 and about 0.3 inches, wherein the bristles in the second area are straight, wherein for the bristles in the third area each bristle further comprises of a lower section, a middle section, and a tip section, wherein the distance between a point on the bristle perpendicular axis and the equivalent point on the bristle center line is about 0 throughout the tip section, and the distance between a point on the bristle perpendicular axis and the equivalent point on the bristle center line gradually varies from between about 0 and about 0.3 inches for about 10% to 90% of the bristles throughout the lower section and middle section.

16. The hair grooming brush of claim 10 wherein for the bristles in the first area, the distance between a point on the bristle perpendicular axis and the equivalent point on the bristle center line varies from about 0 and about 0.3 inches, wherein the bristles in the second area are straight, wherein for the bristles in the third area each bristle further comprises of a lower section, a middle section, and a tip section, wherein the distance between a point on the bristle perpendicular axis and the equivalent point on the bristle center line gradually varies from between about 0 and about 0.3 inches, for about 10% to 90% of the bristles, throughout the lower section, middle section and the tip section.

17. The hair grooming brush of claim 10 wherein each bristle further comprises of a lower section, a middle section, and a tip section, wherein for the bristles in the first area the distance between a point on the bristle perpendicular axis and the equivalent point on the bristle center line is about 0 throughout the lower section and the tip section, and wherein for the second area and third area the distance between a point on the bristle perpendicular axis and the equivalent point on the bristle center line gradually varies from between about 0 and about 0.3 inches for about 10% to 90% of the bristles throughout the middle section.

18. The hair grooming brush of claim 10 wherein the platform includes a handle.

19. The hair grooming brush of claim 10 wherein the plurality of rows alternate between a row of bristles, wherein the distance between a point on the bristle perpendicular axis and the equivalent point on the bristle center line varies from about 0 and about 0.3 inches for about 10% to 90% of the bristles, and wherein the remainder of the bristles are straight; and wherein for an alternate adjacent row the distance between a point on the bristle perpendicular axis and the equivalent point on the bristle center line is about 0.

* * * * *